United States Patent [19]

Fraser

[11] 4,433,643

[45] Feb. 28, 1984

[54] METHOD AND APPARATUS FOR THE SUPPORT OF ANIMALS

[76] Inventor: Charles E. O. Fraser, 79 Marlborough, Southborough, Mass. 01772

[21] Appl. No.: 386,802

[22] Filed: Jun. 9, 1982

[51] Int. Cl.[3] ..... A61D 3/00

[52] U.S. Cl. ..... 119/103

[58] Field of Search ..... 119/103, 96, 98, 99; 269/901, 902, 289 R; 5/57 C; 108/112; 248/156, 174

[56] References Cited

U.S. PATENT DOCUMENTS

| | | | |
|---|---|---|---|
| 89,850 | 5/1869 | Cady | 119/103 |
| 389,063 | 9/1888 | Dimick | 119/103 |
| 833,692 | 10/1906 | Neff | 119/103 |
| 1,377,102 | 5/1921 | Stambaugh | 108/112 |

*Primary Examiner*—Hugh R. Chamblee

*Attorney, Agent, or Firm*—George E. Kersey

[57] ABSTRACT

A compact collapsible support for animals formed by a set of hinged members which can be arranged to form a cradle that is maintained by the weight of the animal and is thereafter collapsed when the animal has been removed and the support is to be stored.

10 Claims, 6 Drawing Figures

METHOD AND APPARATUS FOR THE SUPPORT OF ANIMALS

BACKGROUND OF THE INVENTION

This invention relates to the support of animals, and more particularly, to the support of animals for examination and treatment.

When an animal is subjected to veterinary examination or treatment, it is often desirable for the animal to be supported in a way that facilitates the procedure. For that purpose a number of supporting structures have been devised. Many such structures include intricate mechanisms for assuring the desired relative immobility and support of the animal during the examination or treatment procedure.

In addition, the ordinary support mechanism for veterinary purposes is bulky and comparatively expensive. In situations where a veterinarian travels to an examination or treatment site away from his office, the customary support mechanism is generally not available. Where it is essential to have a support member at the examination or treatment site, there is the added disadvantage and inconvenience of having to transport at relatively bulky and inefficient support device.

Accordingly, it is an object of the invention to facilitate the support of animals, particularly for examination and treatment.

Another object is to provide a non-bulky support structure which, nevertheless, can function suitably for the examination or treatment of animals. A related object is to provide a non-bulky support structure which can be collapsed in order to economize on storage and facilitate the transport of the support structure from an office to an outlying examination or treatment site.

Still another object of the invention is to achieve an economic and light weight support structure which is suitable for vetrinary examination or treatment of animals. A related object is to achieve an economic, lightweight structure that is nevertheless stable and durable. Another related object is to achieve durability and stability in a collapsible support structure.

SUMMARY OF THE INVENTION

In accomplishing the foregoing and related objects, the invention provides a base member with hingeable side panels that are, in turn, hingeably secured to cradle members. The base member is desirably in a plurality of parts which are foldable upon one another for convenience in storage and portability of the overall structure.

In accordance with one aspect of the invention, the cradle members are proportioned to form an angle of about 90° when elevated into support position.

In accordance with another aspect of the invention, the base member is about twice as wide as each side panel. When the base member is formed by a plurality of two or more members, the initial half portion of the base member is approximately the same width as the side panel. The actual proportions depend upon the way the panels are hinged together.

In accordance with a particular embodiment of the invention, the base member is in two parts, each of which, depending on hinging, desirably is of the same width as a side panel.

In accordance with a still further aspect of the invention, the cradle members are collectively of greater length than the base members. As a result with the base, side panels and cradle members are hinged to one another, the resulting structure forms a trapezoid when the base member is flat and the cradle members are elevated to a position which is parallel to the base members. In this particular embodiment of the invention, each dradle member is about one and one-half times the wideth of its adjoining side panel.

In accordance with yet another aspect of the invention, the base member is formed by two portions which are hinged together with a notch inbetween to receive the hinge of the cradle members when the structure is in its support position.

In practising the invention, the cradle members are elevated with respect to the base member and the hinge joining the cradle members is placed against the base member, desirably in a notch, in order to form a stable support that retains its support configuration as long as weight is applied to the cradle.

In accordance with still another aspect of the invention, the cradle members are positioned to form an angle of about 90° between them and weight is applied to the angled cradle member in order to maintain them in a support position against the base.

In accordance with a yet further aspect of the invention, the support structure is collapsed by decreasing the angle between the cradle members until their sides are in contact and pressing both the side panels and base portion against the cradle members.

DESCRIPTION OF THE DRAWINGS

Other aspects of the invention will become apparent after considering several illustrative embodiments taken in conjunction with the drawings in which.

DETAILED DESCRIPTION

Figure 1:
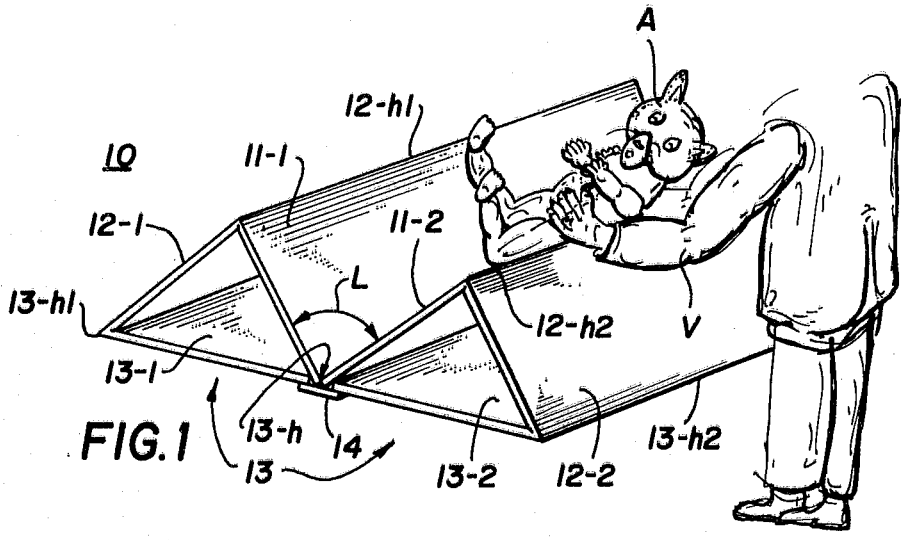
FIG. 1 is a perspective view of a support structure in accordance with the invention shown in its support position.

With reference to the drawings, a support structure 10 in accordance with the invention is shown in FIG. 1 with an illustrative animal A cradled between panels 11-1 and 11-2 in position for being examined or treated by a veterinarian V.

The support structure 10 includes side panels 12-1 and 12-2 which are hinged to the respective cradle members 11-1 and 11-2. The side panels 12-1 and 12-2 are further hinged to respective members 13-1 and 13-2 of a base member 13.

As indicated in FIG. 1, the base 13 is desirably in two sections 13-1 and 13-2 which meet at the hinge position 11-h at the junction of the cradle members 11-1 and 11-2. The panels 13-1, 12-1, 11-1, 11-2, 12-2 and 13-2 are desirably fabricated from a single sheet of material, with the hinges between the panels formed in the adjoining material. Where the panels are made from pressboard, the hinges 11-h, 12-h2, 12-h1, 13-h1 and 13-h2 are formed by scoring. Where the panels are of plastic, the hinges are formed by molding or die pressure. The ends of the base panels 13-1 and 13-2 are advantageously joined by an adhesive strip 14 leaving a notch 13-n between the ends of the base panels 13-1 and 13-2. The notch 13-n receives the hinge 11-h and helps stabilize the support structure 10 when it is in its support position.

It will be appreciated that the tape strip 14 may be positioned elsewhere on the structure and that a hinge between the members 13-1 and 13-2 may be included with proportions to stabilize the hinge 11-h in the manner previously described. In that event, the adhesive strip 14 may be included at any of the other hinge positions, for example in place of hinge 13-h1, 12-h1, 12-h2 or 13-h2.

Figure 2:
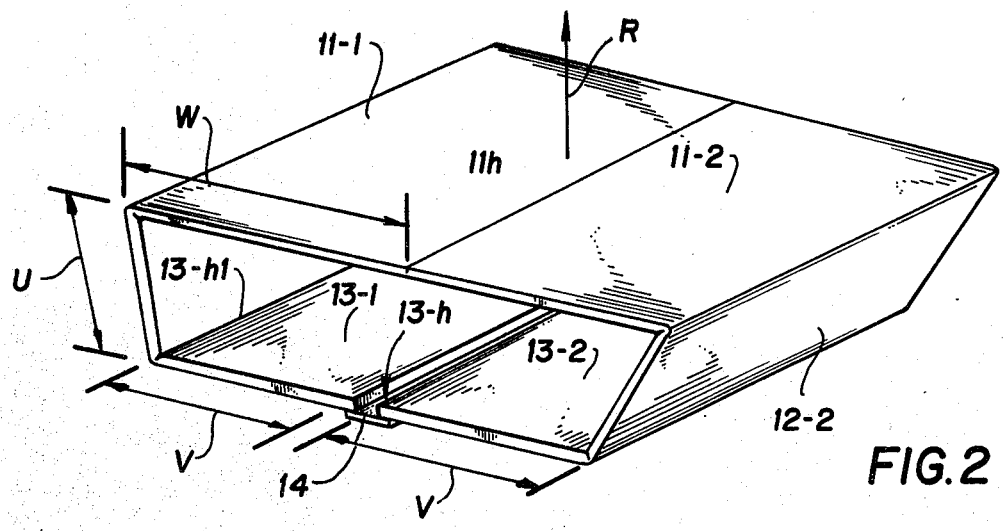
FIG. 2 is a perspective view showing the trapezoidal cross section produced when the base is flat and the cradle members are elevated so that they are parallel with the base.

Various structural characteristics of the support 10 are illustrated in FIG. 2 where the hinge 11-h, with the animal A removed, has been elevated in the direction indicated by the arrow R until the cradle members 11-1 and 11-2 are parallel with the base members 13-1 and 13-2. In this position it is seen that each of the cradle members 11-1 and 11-2 has a width w which is greater than that of the width v of each of the base members 13-1 and 13-2.

In addition, the widths u of the side panels 12-1 and 12-2 are less than the widths v and w. In an illustrative embodiment of the invention, the widths u, v and w are in the ratio of 5¼ to 6 to 7. In any event, the parts are proportioned so that the cradle members 11-1 and 11-2 form an angle L in FIG. 1 of about 90°.

Figure 3:
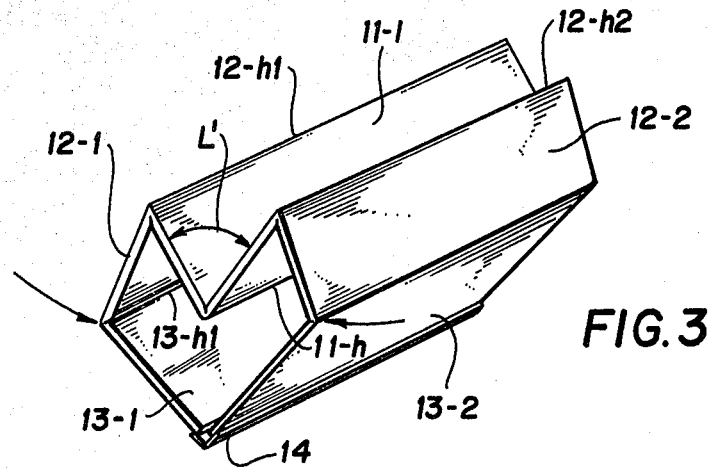
FIG. 3 is a perspective view illustrating the support structure in the course of being collapsed after the supported animal has been removed and the support structure is to be stored or transported to another location.

To collapse the structure 10, one procedure is illustrated in FIG. 3. The structure 10 is gripped on opposite sides in the vicinity of each of the hinges 13-h1 and 13-h2 and the associated panels 12-1 and 12-2 are elevated causing a reduction in the angle L′ between the cradle members 11-1 and 11-2. There is simultaneously an approach of the base panels 13-1 and 13-2 as well as side panels 12-1 and 12-2 towards the cradle panels 11-1 and 11-2. When the panels 12-1, 12-2, 13-1 and 13-2 are collapsed against the cradle members 11-1 and 11-2 the result is as indicated in FIG. 4C and the structure is ready for storage.

Figure 4A:
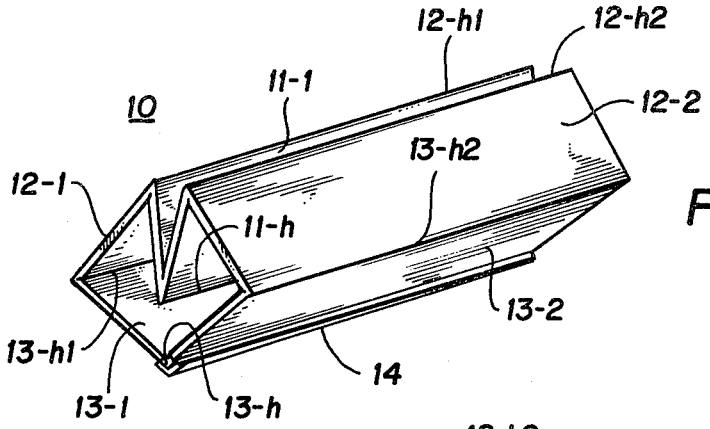
FIG. 4A is a perspective view illustrating an alternative technique for collapsing the support structure by bringing its cradle members together.
Figure 4B:
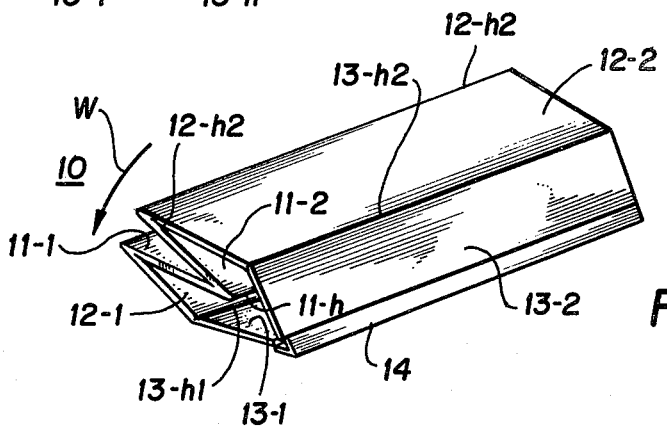
FIG. 4B is a perspective view illustrating the collapse of the structure in FIG. 4A by tilting it to one side.
Figure 4C:
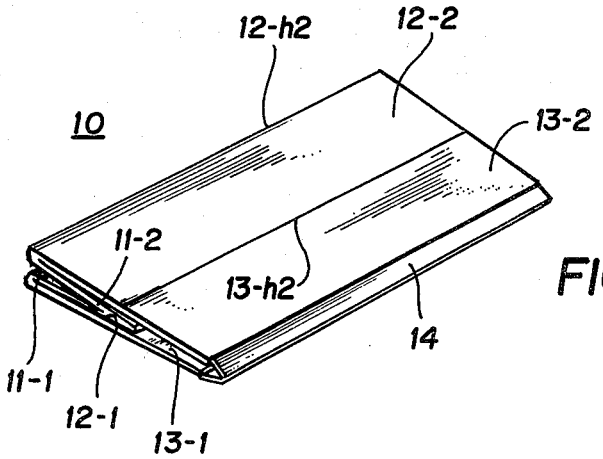
FIG 4C is a perspective view of the collapsed support structure which results whe the structure is collapsed either according to the technique of FIGS. 4A and 4B or the technique of FIG. 3.

An alternative technique for collapsing the structure 10 is illustrated in FIG. 4A. The cradle members 11-1 and 11-2 are drawn together, reducing the angle L″ to zero and causing the base and side panels to form a rhombic cross section. When The partially collapsed structure in FIG. 4A is allowed to lean on its side as shown in FIG. 4B, the cradle members 11-1 and 11-2, together with the side panels 12-1 and 12-2 fall in the direction indicated by the arrow W resulting in the collapsed structure as illustrated in FIG. 4C.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. Apparatus for the support of animals which comprises a base member;

a first side panel hingeably secured to one end of said base member;

a second side panel hingeably secured to the other end of said base member;

first and second cradle members hingeably secured to one another and being further hinged at one end to said first side panel and further hingeably secured at the other end to said second side panel.

2. Support apparatus as defined in claim 1 wherein said base member has a hinge connection and is foldable upon itself.

3. Support apparatus as defined in claim 1 wherein means hold said cradle members at an angle of about 90 degrees therebetween when elevated into support position.

4. Support apparatus as defined in claim 1 wherein said base member is about twice as wide as each side panel and is about one and one-half times as wide as each cradle member.

5. The support apparatus as defined in claim 1 comprising (a) cradle members elevated with respect to said base member; and (b) a hinge positioned between said cradle members against said base member;

thereby to form a stable support that retains its support configuration as long as weight is applied to said cradle members.

6. The apparatus of claim 5 including the support the weight removed from said cradle members and the hinge elevated therebetween above said base member.

7. The support apparatus as defined in claim 1 which comprises (a) said cradle members positioned to form an angle of 90 degrees therebetween; and (b) weight applied to the angled cradle members to maintain said members in a support position.

8. The apparatus of claim 7 including said support structure collapsed by removing weight from said cradle member and the angle increased between said cradle members above 90 degrees.

9. Support apparatus as defined in claim 1 wherein said base member, said first side panel, said second side panel, and said first and second cradle members are connected to one another to form a closed structure.

10. Apparatus as defined in claim 9 wherein said closed structure is trapazoidal in cross section.

* * * * *